US007416088B2

(12) United States Patent
Boukobza

(10) Patent No.: US 7,416,088 B2
(45) Date of Patent: Aug. 26, 2008

(54) CONTAINER MADE FROM THERMOPLASTIC MATERIAL WITH A DOMED BASE

(75) Inventor: Michel Boukobza, Octeville sur Mer (FR)

(73) Assignee: Sidel, Octeville-sur-Mer (FR)

( * ) Notice: Subject to any disclaimer, the term of this patent is extended or adjusted under 35 U.S.C. 154(b) by 293 days.

(21) Appl. No.: 10/561,186

(22) PCT Filed: Jun. 11, 2004

(86) PCT No.: PCT/FR2004/001477

§ 371 (c)(1),
(2), (4) Date: Dec. 16, 2005

(87) PCT Pub. No.: WO2005/002982

PCT Pub. Date: Jan. 13, 2005

(65) Prior Publication Data

US 2007/0000858 A1 Jan. 4, 2007

(30) Foreign Application Priority Data

Jun. 19, 2003 (FR) ..... 03 07389

(51) Int. Cl.
*B65D 1/02* (2006.01)
*B65D 1/42* (2006.01)

(52) U.S. Cl. ..... 215/373; 215/371; 220/606; 220/608

(58) Field of Classification Search ..... 215/371, 215/373–375; 220/606, 608, 609
See application file for complete search history.

(56) References Cited

U.S. PATENT DOCUMENTS 4,054,219 A * 10/1977 Young et al. ..... 215/375
4,254,882 A 3/1981 Yoshino
4,598,831 A * 7/1986 Nakamura et al. ..... 215/373
4,981,736 A * 1/1991 Feddersen et al. ..... 428/36.92
4,993,566 A * 2/1991 Eberle ..... 215/373
5,005,716 A * 4/1991 Eberle ..... 215/373
5,236,097 A * 8/1993 Behm et al. ..... 215/373
5,989,661 A * 11/1999 Krishnakumar et al. .... 428/35.7
6,065,624 A 5/2000 Steinke
6,585,123 B1 * 7/2003 Pedmo et al. ..... 215/10

FOREIGN PATENT DOCUMENTS

EP 1 364 880 A 11/2003
JP 2000 229615 A 8/2000

* cited by examiner

*Primary Examiner*—Sue A Weaver
(74) *Attorney, Agent, or Firm*—Sughrue Mion, PLLC

(57) ABSTRACT

A container made from thermoplastic material, of the type with a domed base, including a central projecting pimple, a peripheral support region and an intermediate arch, provided with ribs, extending from the central pimple to the support region but not therein, the ribs having a dihedral form with a straight section in a V in the medial plane, essentially parallel to the axis of the container and running into each other without a break. The ribs have a longitudinal profile which is curvilinear, the bases of the ribs, in the region thereof adjacent to the central pimple, extending higher than the base of said central pimple and the bases and crests of the ribs, in the region thereof adjacent to the support region, having curves merging progressively into a continuous rounding of unbroken curvature immediately above the support region such that the latter is essentially planar and continuous over the whole length thereof.

4 Claims, 1 Drawing Sheet

FIG. 1
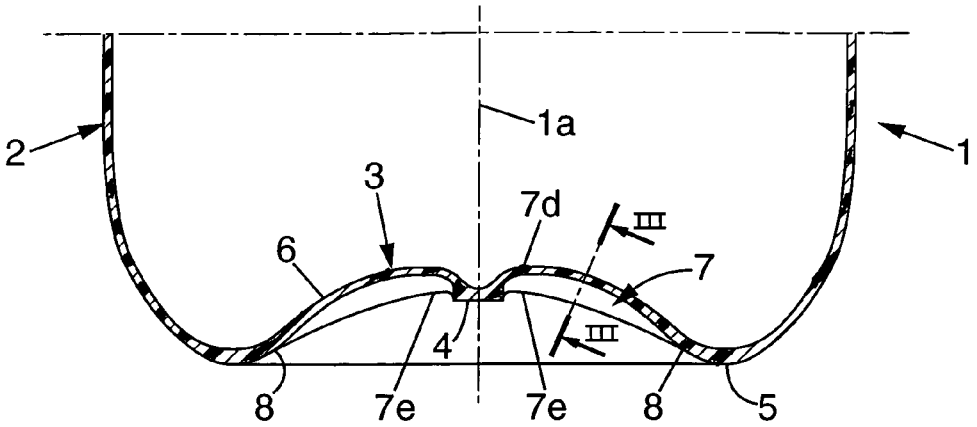
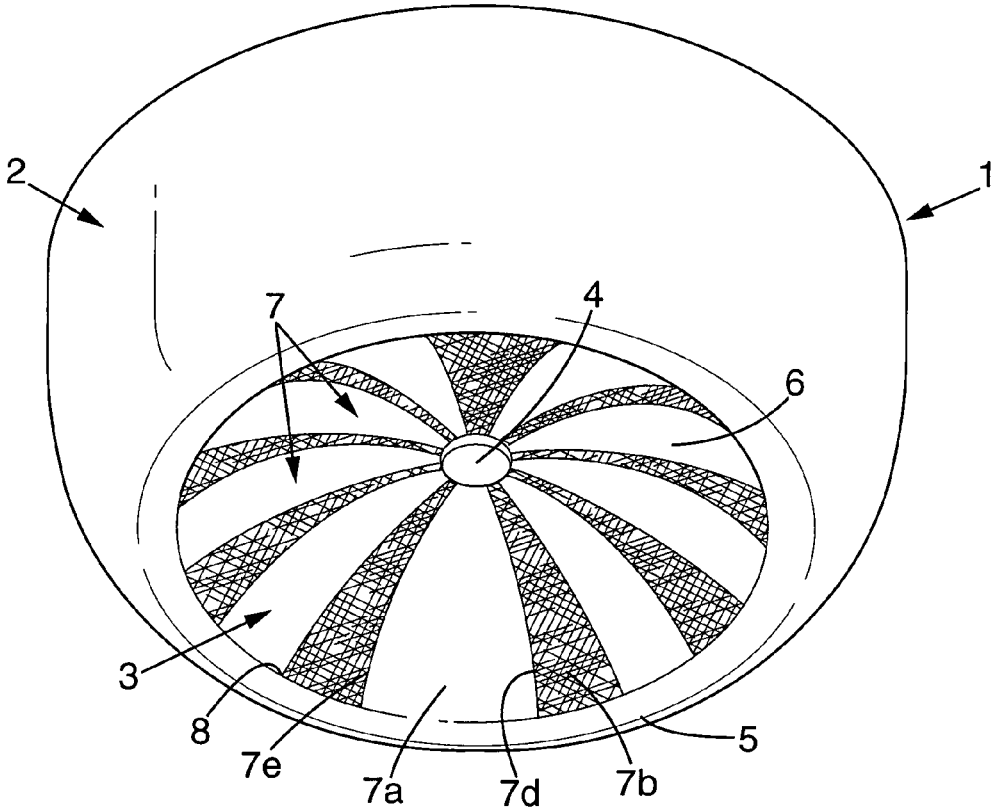
FIG. 2
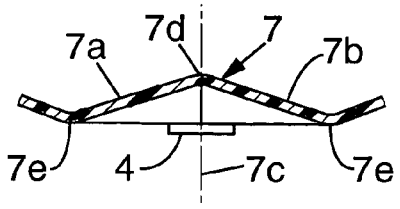
FIG. 3

CONTAINER MADE FROM THERMOPLASTIC MATERIAL WITH A DOMED BASE

FIELD OF THE INVENTION

The present invention relates to improvements made to containers made of thermoplastic and provided with a bottom of the type known as a "champagne bottom" (that is to say a bottom that is steeply domed or dimpled toward the inside of the container), said bottom comprising a downwardly projecting central pimple (that is to say one in the concave face of the bottom), a peripheral bearing region via which the container can stand stably on a substantially flat support, and ribs radiating from said central pimple as far as said peripheral bearing region.

DESCRIPTION OF THE PRIOR ART

So-called "champagne bottoms" offer the advantage of making it possible to produce a peripheral bearing region that is flat and above all continuous over the entirety of its extent, so that they afford the containers placed on a substantially flat support a remarkably stable footing. Bottoms of this type are particularly advantageous when the containers are filled with pressurized liquid (for example fizzy drinks) because these bottoms, because of their highly inwardly convex shape, are intrinsically able to withstand the pressure applied to them from the inside, and therefore remain stable.

However, obtaining these advantageous characteristics entails a sufficient thickness of thermoplastic, which thickness is appreciably greater than the thickness of the wall of the body of the containers (see, for example, document FR 2 730 471) which makes manufacturing the containers by blow-molding or stretch-blow-molding from heated performs more tricky.

Numerous embodiment variants of champagne bottoms which tend toward the obtaining of improved flatness and stability of said bottoms, often in conjunction with a desire to minimize the thickness of the material and therefore the cost of these containers, are known.

SUMMARY OF THE INVENTION

It is an object of the invention to propose a novel champagne bottom structure which combines all the advantageous characteristics inherent to this type of bottom while at the same time allowing a saving on the amount of material needed for producing the containers and therefore allowing their cost to be reduced.

To these ends, the invention proposes a container made of a thermoplastic material and provided with a bottom of the "champagne bottom" type comprising a downwardly projecting central pimple, a peripheral bearing region and an intermediate arch provided with ribs radiating from the central pimple as far as the bearing region, which container, being arranged in accordance with the invention, is characterized in that

- the ribs extend from the central pimple as far as the bearing region but exclude this region,
- the ribs are of dihedral shape with a V-shaped cross section the mid-plane of which is substantially parallel to the axis of the container and follow on from one another without discontinuity, and
- the ribs have a longitudinal profile which is curved, the valley bottoms of the ribs, in their region adjacent to the central pimple, coming up higher than the base of said central pimple and the valley bottoms and crests of the ribs, in their regions adjacent to the bearing region, having curvatures which blend gradually into a continuous rounded feature with no break in curvature immediately above the bearing region so that the latter is substantially flat and continuous over its entire extent.

By virtue of this arrangement, the arch of the champagne bottom which extends between the central pimple and the peripheral bearing region has improved mechanical strength not only because of the presence of the ribs but also because of the actual shape of the ribs which, being arranged one after the next without discontinuity, bear against one another and strengthen each other. This mechanical strength is also improved as a result of the special longitudinal profile of each rib, with the valley bottom of each rib which, starting from the central pimple, comes up higher than the latter toward the inside of the container and therefore has a very pronounced curvature with its convex side facing toward the inside of the container, giving it better ability to withstand the pressure.

All these individual characteristics combine with one another to yield a champagne bottom that is stronger than the currently known bottoms and which is therefore capable either, for the same wall thickness as known bottoms, to withstand higher pressures without deformations or, advantageously, of being made with a smaller wall thickness in order to be able to withstand a given pressure.

It should be noted here that the possible reduction in thickness relates not only to the arch equipped with said dihedral ribs but also and above all to the peripheral bearing region, the thickness of which is traditionally the greatest.

Advantageously, the central pimple is in the shape of a downwardly projecting circular plateau. This arrangement stabilizes the center of the bottom and gives it a constant geometry, independent of the precise position of the pellet of crystallized material resulting from the process of injection-molding the preform. This, as far as the bottom is concerned, results in an improved overall shape that is symmetric, making it easier to obtain the flatness of the peripheral bearing region.

The arrangements of the invention find application in particular when the container is made of PET.

A favorite application of the arrangements of the invention is when the container is a bottle the overall shape of which is approximately that of a cylinder of revolution and the bearing region is annular and substantially coaxial with the central pimple, the dihedral ribs extending radially. As a preference, this container comprises ribs each having the same angular breadth. In this case, in the typical exemplary embodiment of a bottle with a bearing-region diameter of the order of 45 mm, the bottom of the bottle has ten or so ribs each having the same angular breadth. More generally, it is possible to envisage for the number of ribs to vary substantially with the diameter of the bearing region, particularly between 8 and 16 for standard-diameter bottles.

The arrangements according to the invention may lead to substantial savings in material. By way of example, in the case of a bottle having a capacity of 1.5 liters and a bottom diameter of the order of 70 mm (measured in the bearing region) and provided, as mentioned above, with 10 dihedral ribs, it is possible to obtain a saving of the order of 8 to 15% on material by reducing the thickness of the arch and to make a saving of the same order of magnitude by reducing the thickness in the bearing region, while at the same time obtaining mechanical strength characteristics that are at least identical, or even improved, by comparison with known bottoms.

BRIEF DESCRIPTION OF THE DRAWINGS

The invention will be better understood from reading the detailed description which follows of some arrangements according to the invention which are illustrated, by way of example, in the attached drawings in which:

FIG. 1 is a diagrammatic view in section of the lower part of a thermoplastic bottle with a bottom formed in accordance with the invention;

FIG. 2 is a perspective view from beneath of the lower part of the bottle illustrated in FIG. 1; and FIG. 3 is a view in section on line III-III of FIG. 1, of a rib of the bottom in accordance with the invention.

DETAILED DESCRIPTION OF THE INVENTION

FIGS. 1 and 2 illustrate, by way of example, the lower part of a bottle 1 the overall shape of which is approximately that of a cylinder of revolution, the side wall 2 of which connects at the lower extremity to a bottom 3 of the "champagne bottom" type, that is to say one steeply domed or dimpled toward the inside.

The bottle 1 is made of thermoplastic, particularly of PET, and manufactured by a process of blow-molding or stretch-blow-molding a preform.

The bottom 3 comprises: a central pimple 4 (consisting of or including the pellet of crystallized material that results from the process of injection-molding the preform), which is advantageously produced in the shape of a downwardly projecting circular plateau; a peripheral bearing region 5, in this instance of annular shape, which extends substantially in a plane so that the container can rest stably on a flat support; and an intermediate region or arch 6 equipped with ribs 7 radiating from the central pimple 4 as far as the bearing region 5.

According to the invention, the ribs 7 extend from the central pimple 4 as far as the bearing region 5 but exclude this region; in other words, the ribs do not encroach upon the bearing region 5 which thus extends continuously in an annulus.

In addition, as can be seen in FIG. 2 and especially in FIG. 3, the ribs 7 are dihedral in shape, that is to say they are formed of two flat walls 7*a*, 7*b* inclined with respect to one another with a V-shaped cross section that is symmetric with respect to the mid-plane 7*c* substantially parallel to the axis 1*a* of the bottle and passing through said axis.

As can be seen in FIG. 2, all the dihedral ribs 7 follow on from one another without any discontinuity so that all the ribs distributed in a circle rest against one another and strengthen each other, leading to an arch 6 that has a better mechanical strength and is better able to withstand the pressure applied to it.

As can be seen particularly in FIG. 1, the ribs 7 have a curved longitudinal profile. The valley bottoms 7*d* of the ribs, in their region adjacent to the central pimple 4, come up higher than the base of said pimple 4, which means that the valley bottoms 7*d* in this region have a very pronounced curvature whereas, in the same region, the crests 7*e* of the ribs diverge from the central pimple substantially at right angles to the axis 1*a*. This arrangement plays a part in strengthening the arch 6.

The valley bottoms 7*d* and the crests 7*e* of the ribs 7 have respective longitudinal profiles such that, toward the periphery of the bottom, they have curvatures that merge progressively into a continuous rounded feature with no break in curvature immediately above (at 8) the bearing region 5, so that this region is flat and continuous over its entire extent.

The invention claimed is:

1. A container made of a thermoplastic material and provided with a bottom of the "champagne bottom" type comprising a downwardly projecting central pimple, a peripheral bearing region and an intermediate arch provided with ribs radiating from the central pimple as far as the bearing region, wherein:

said central pimple has a shape of a downwardly projecting circular plateau, said ribs are of dihedral shape with a V-shaped cross section, the mid-plane of which is substantially parallel to the axis of the container, and said ribs follow one another without discontinuity so as to define alternate valley bottoms and crests, and said dihedral-shaped ribs extend with a curved longitudinal profile from said central pimple as far as the bearing region but excluding said bearing region, with said valley bottoms having respective radially inner end regions adjacent to the central pimple which come up higher than a base of said central pimple and with said valley bottoms and crests having respective radially outer end regions adjacent to the bearing region which have respective curvatures blending gradually into a continuous rounded form of said bearing region, with no break in curvature in said respective radially outer end regions of said valley bottoms and crests immediately above said bearing region, so that said bearing region is substantially planar and continuous over its entire extent, whereby the rigidity of said bottom is increased while at the same time the thickness thereof is reduced, including in the bearing region.

2. The container as claimed in claim 1, said container being made of PET.

3. The container as claimed in claim 1, said container being a bottle the overall shape of which is approximately that of a cylinder of revolution and the bearing region is annular and substantially coaxial with the central pimple, the dihedral ribs extending radially.

4. The container as claimed in claim 3, said container comprising ribs each having the same angular breadth.

* * * * *